US010336518B2

(12) United States Patent
Barnett

(10) Patent No.: US 10,336,518 B2
(45) Date of Patent: Jul. 2, 2019

(54) LOCKING DRINK CONTAINER

(71) Applicant: Keith T. Barnett, Holmes, NY (US)

(72) Inventor: Keith T. Barnett, Holmes, NY (US)

( * ) Notice: Subject to any disclaimer, the term of this patent is extended or adjusted under 35 U.S.C. 154(b) by 161 days.

(21) Appl. No.: 15/723,531

(22) Filed: Oct. 3, 2017

(65) Prior Publication Data

US 2018/0290801 A1 Oct. 11, 2018

Related U.S. Application Data

(60) Provisional application No. 62/483,958, filed on Apr. 11, 2017.

(51) Int. Cl.
*B65D 55/14* (2006.01)
*B65D 43/02* (2006.01)
*A47G 19/22* (2006.01)

(52) U.S. Cl.
CPC ..... *B65D 55/145* (2013.01); *B65D 43/0235* (2013.01); *A47G 19/2266* (2013.01); *A47G 19/2272* (2013.01); *A47G 2400/123* (2013.01)

(58) Field of Classification Search
CPC .. B65D 50/046; B65D 50/041; B65D 55/145; B65D 55/14; B65D 55/02; B65D 43/0235; B65D 43/02; B65D 43/12; B65D 51/18; B65D 51/245; B65D 51/24; A47G 19/2272; A47G 19/2266
USPC ..... 215/221, 218, 217, 228, 230, 215; 220/259.3, 256.1, 254.9, 254.8, 254.1, 220/345.4, 345.2, 345.1, 212, 210
See application file for complete search history.

(56) References Cited

U.S. PATENT DOCUMENTS 5,284,262 A * 2/1994 O'Nan ..... B65D 55/145 215/206
5,579,932 A * 12/1996 Drozd ..... B65D 50/041 215/201

* cited by examiner

*Primary Examiner* — Robert J Hicks
(74) *Attorney, Agent, or Firm* — Law Offices of Michael L. Wise, LLC

(57) ABSTRACT

An apparatus includes a cap assembly and a container assembly. The cap assembly may be unscrewed from the container assembly by simultaneously pressing a predetermined combination of buttons available on the top of the cap assembly. If the predetermined combination of buttons is not precisely and exclusively selected, the cap assembly resists being unscrewed from the container assembly and a beverage inside remains inaccessible. A user of the apparatus who knows the correct combination of buttons will thereby be able to readily access the beverage in the container assembly, but one without that knowledge will not. Tampering is avoided.

15 Claims, 7 Drawing Sheets

LOCKING DRINK CONTAINER

FIELD OF THE INVENTION

The present invention relates generally to containers, and, more particularly, to locking containers for protecting beverages from tampering.

BACKGROUND OF THE INVENTION

Drug facilitated sexual assault (DFSA) is unfortunately becoming more and more commonplace in the United States. A wrongdoer may attempt to perpetrate a DFSA by surreptitiously placing an incapacitating drug into a victim's drink. The drug makes the victim vulnerable to the assault. Common drugs include flunitrazepam, ketamine, and gamma-hydroxybutyrate (GHB).

Beverages at many social gatherings are served in open-topped containers that do not lend themselves well to protecting against DFSA. Even when closed-topped containers are utilized, a perpetrator may still access the enclosed liquid simply by removing the container's cap. The cap may then be replaced and the potential victim may have no idea that the drink has been compromised.

For the foregoing reasons, there is a need for containers that provide a means of protecting a person's drink from tampering.

SUMMARY OF THE INVENTION

Embodiments of the present invention address the above-identified needs by providing locking drink containers that may be used to protect one's drink from tampering.

Aspects of the invention are directed to an apparatus comprising a container, a locking tray attached to the container, and a cap assembly. The locking tray comprises an externally threaded cylinder defining a plurality of outward-facing notches about its base, and an outer circumferential ring defining a plurality of inward-facing teeth about its circumference. The cap assembly comprises an internally threaded cylinder, a lock tab operative to slide radially towards and away from the internally threaded cylinder between an inward position and an outward position, a spring-biased lock button translationally coupled to the lock tab and urging the lock tab towards its outward position when the spring-biased lock button is unpressed and positioning the lock tab in its inward position when the spring-biased lock button is pressed, a stop tab operative to slide radially towards and away from the internally threaded cylinder between an inward position and an outward position, and a spring-biased stop button translationally coupled to the stop tab and urging the stop tab towards its outward position when the spring-biased stop button is unpressed and positioning the stop tab in its inward position when the spring-biased stop button is pressed. The lock tab is operative to engage one or more of the plurality of inward-facing teeth as the internally threaded cylinder is threadably engaged with the externally threaded cylinder with the spring-biased lock button unpressed. The stop tab is operative to engage one of the plurality of outward-facing notches with the internally threaded cylinder threadably engaged with the externally threaded cylinder and the spring-biased stop button pressed.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

The present invention will be described with reference to illustrative embodiments. For this reason, numerous modifications can be made to these embodiments and the results will still come within the scope of the invention. No limitations with respect to the specific embodiments described herein are intended or should be inferred.

As used herein and in the appended claims, the term "container" is intended to be interpreted broadly and would encompass any apparatus capable of containing a liquid. The term "container" would therefore cover a bottle, cup, mug, beaker, flask, jug, carafe, decanter, thermos, canteen, and the like. The term "substantially identical in shape" means identical in shape within customary manufacturing tolerances for parts of the type considered. A part may be "manually unscrewed" from another part if a person of average strength and dexterity can accomplish the unscrewing using only the person's hands and without tools. Finally, a spring-biased button is "pressed" if it is moved by a user to the full extent possible in a direction opposite to the bias of its spring. A spring-biased button is "unpressed" if a user does not directly apply a force to the button.

Figure 1:
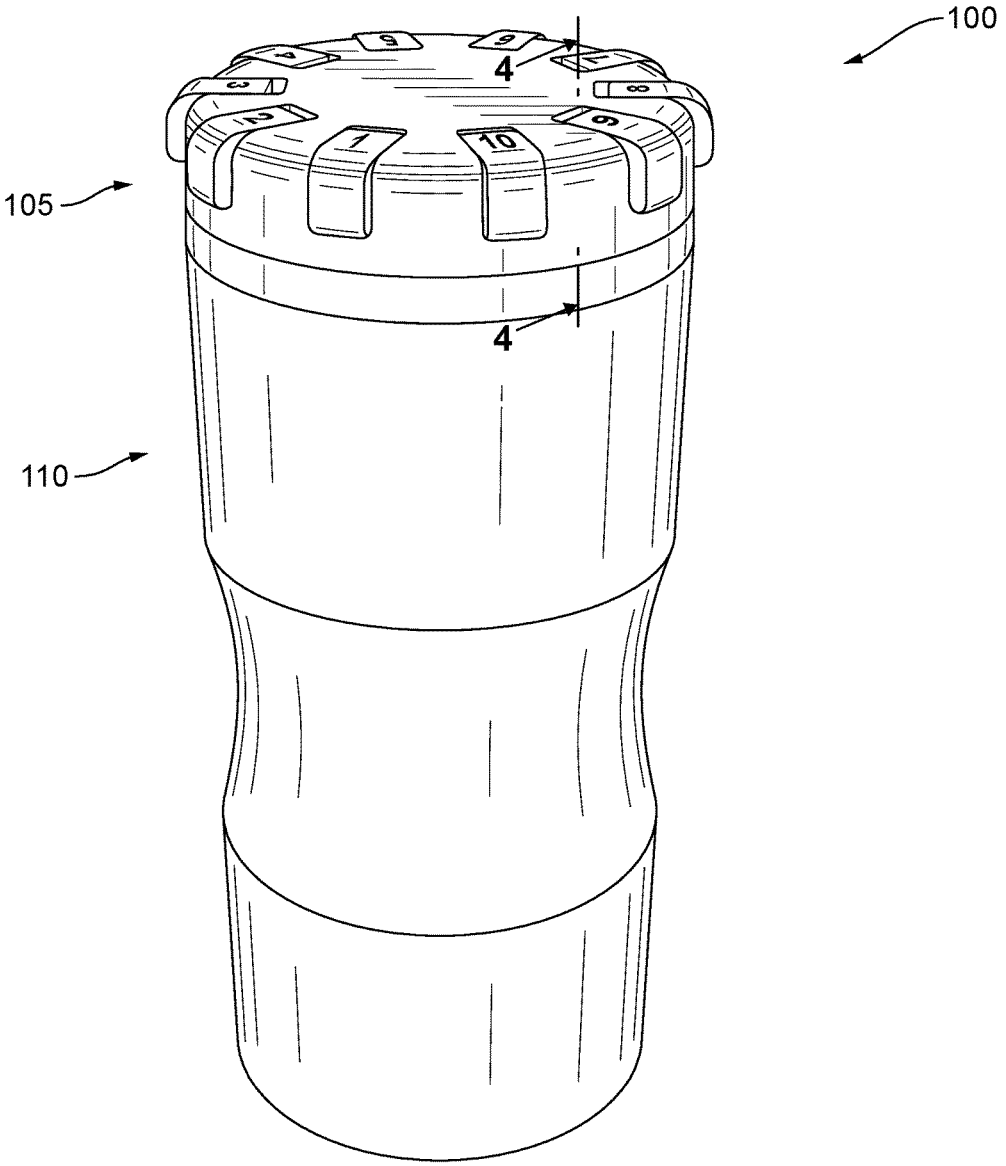
FIG. 1 shows a perspective view of an apparatus in accordance with an illustrative embodiment of the invention.
Figure 2:
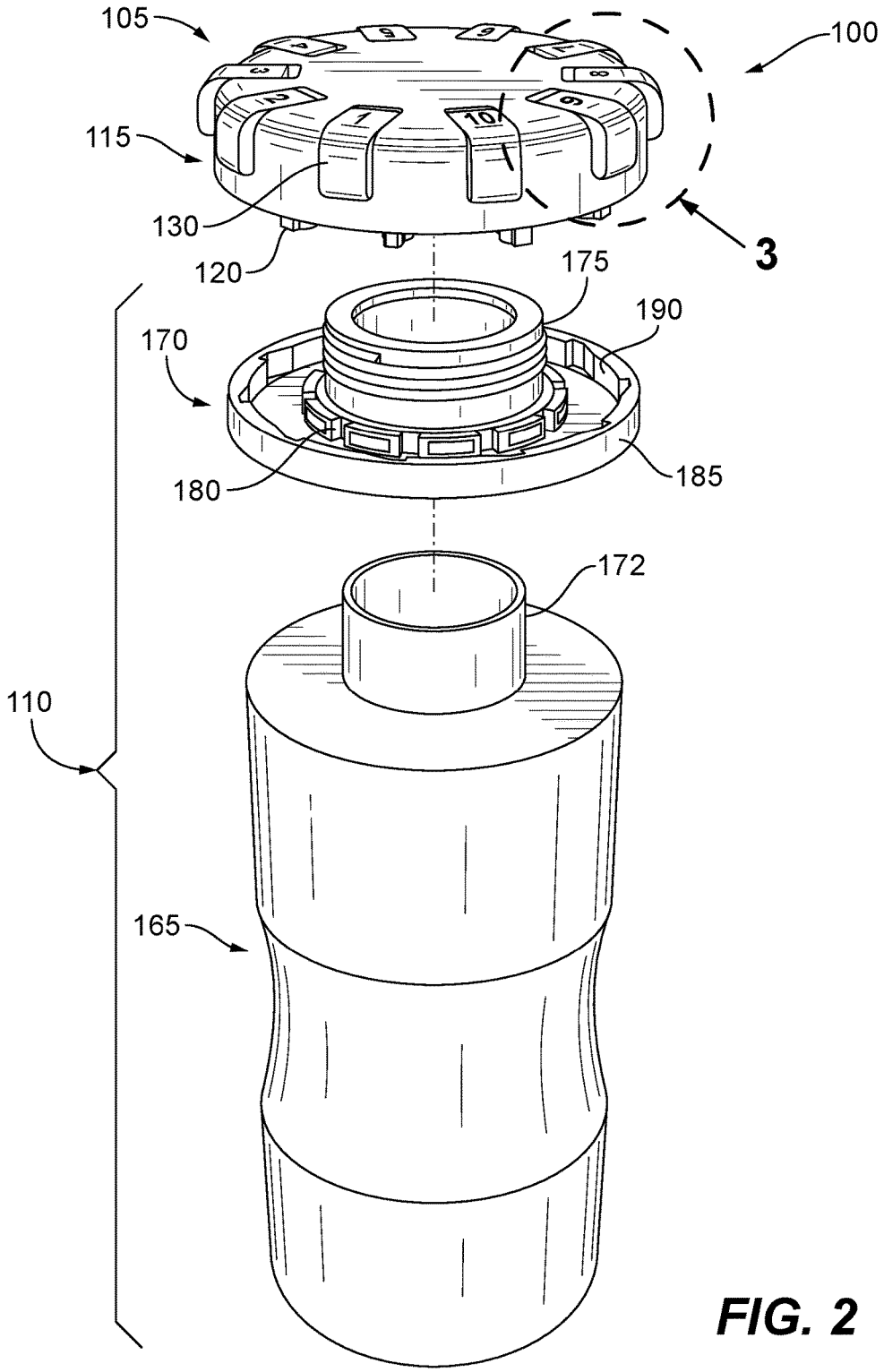
FIG. 2 shows an exploded perspective view of aspects of the FIG. 1 apparatus.
Figure 3:
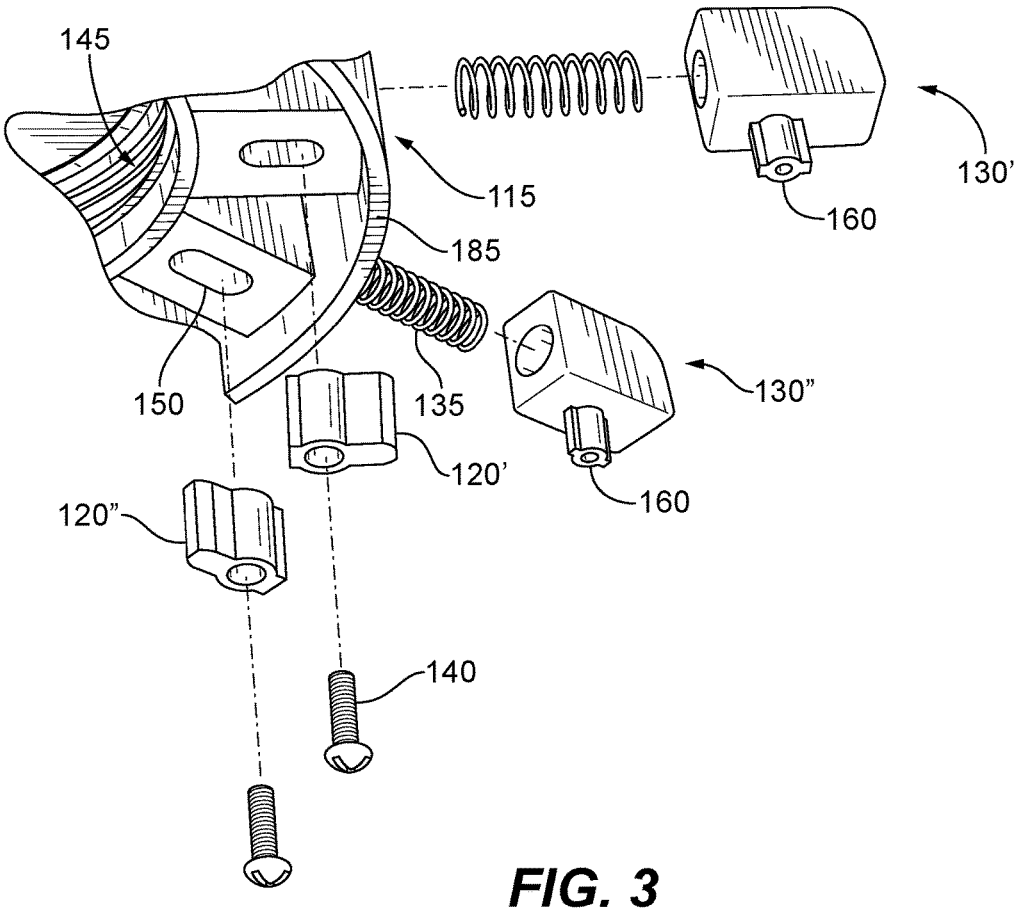
FIG. 3 shows an enlarged exploded perspective view of aspects of the FIG. 1 apparatus in the region encircled in FIG. 2.
Figure 4:
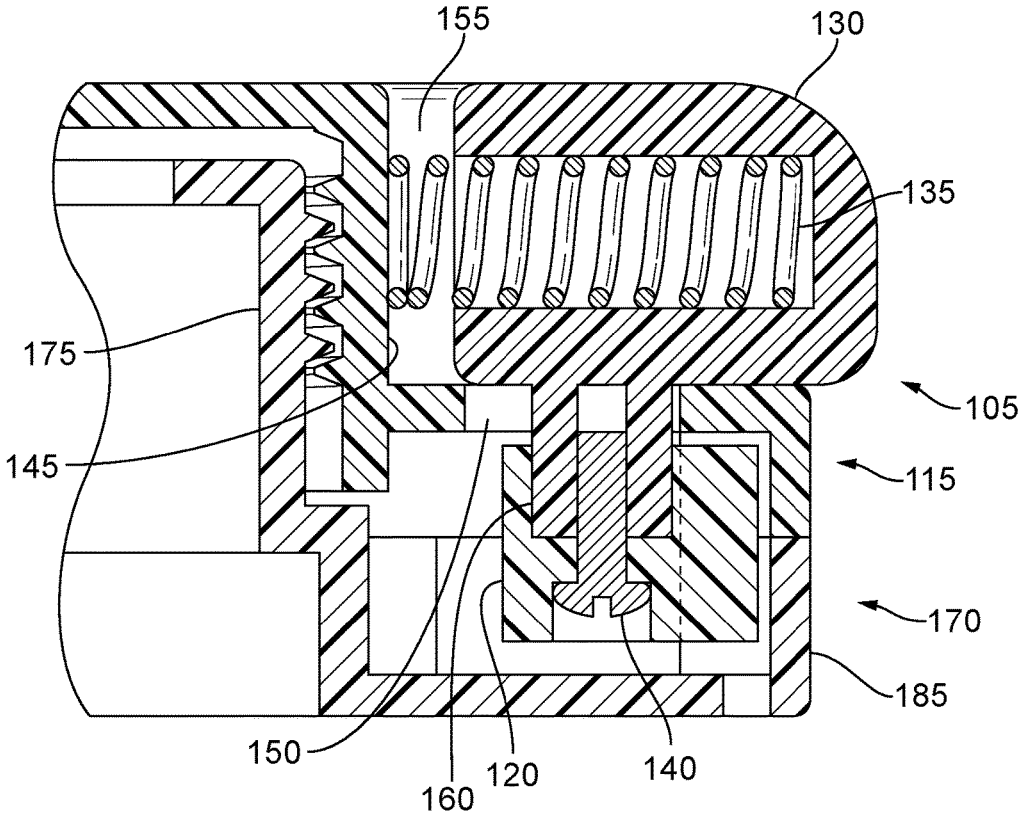
FIG. 4 shows a sectional view of a region of the FIG. 1 apparatus along the cleave plane indicated in FIG. 1.

FIGS. 1-4 show aspects of an illustrative apparatus 100 in accordance with an illustrative embodiment of the invention. FIGS. 1 and 2 show an intact and an exploded perspective view, respectively, of the apparatus 100, while FIG. 3 shows an enlarged exploded perspective view of aspects of the apparatus 100 in the region encircled in FIG. 2. FIG. 4 shows a sectional view of a region of the apparatus 100 along the cleave plane indicated in FIG. 1.

The apparatus 100 comprises a cap assembly 105 and a container assembly 110. The cap assembly 105 may be unscrewed from the container assembly 110 by simultaneously pressing a predetermined combination of buttons available on the top of the cap assembly 105. If the predetermined combination of buttons is not precisely and exclusively selected, the cap assembly 105 resists being unscrewed from the container assembly 110, and the beverage inside remains inaccessible. A user of the apparatus 100 who knows the correct combination of buttons will thereby be able to readily access the beverage in the container assembly 110, but one without that knowledge will not.

The cap assembly 105 comprises a cap body 115, a plurality of tabs 120, a plurality of buttons 130, a plurality of springs 135, and a plurality of screws 140. The cap body 115 is circular, and defines an internally threaded hollow cylinder 145 at its center and a plurality of button slots 150 arranged radially about the internally threaded hollow cylinder 145. Above each button slot 150, a respective button receptacle 155 is dimensioned to hold a button 130. Each button 130 defines a button projection 160 with a keyed shape that passes through its respective button slot 150 and fits into a keyhole in the top of a respective tab 120. Each of the tabs 120 is connected to its respective button projection 160 by a respective one of the screws 140, which threadably engages a threaded opening in the bottom of the button projection 160. This disposes the buttons 130 and the connected tabs 120 on opposite sides of the button slots 150 with the button projections 160 passing therethrough.

The buttons 130 are thereby transitionally coupled to the respective tabs 120 to which they are interconnected, with each of the buttons 130 and their respective tabs 120 operative to slide radially towards and away from the internally threaded hollow cylinder 145 between an inward position and an outward position. A respective one of the springs 135 is partially inserted into each button 130 and biases (i.e., urges) its button 130 towards the outside of the cap body 115. Each of the buttons 130 is thereby spring-biased in the outward direction.

While all the tabs 120 are substantially identical in shape, their orientation with respect to the remainder of the apparatus 100 determines whether they act as a "lock tab" or a "stop tab" (the functions of which will be detailed below). FIG. 3 shows an example of each, with the tab 120' being oriented to serve as a lock tab, and the tab 120" being oriented to serve as a stop tab. Each tab 120 includes a longer projection and a shorter projection, with the shorter projection positioned opposite the longer projection. In the case of a lock tab like the lock tab 120', the longer projection is oriented towards the outside of the apparatus 100. In the case of a stop tab like the stop tab 120", the longer projection is oriented towards the inside of the apparatus 100.

The assignment of a tab 120 as either a lock tab 120' or a stop tab 120" may be customized to a particular user by simply removing its screw 140 and reorienting the tab 120 by 180-degrees relative to its button 130. These two orientations, whichever is chosen, are constrained by the keyed shapes and keyholes of the button projections 160 and the tabs 120, respectively. The screw 140 is then replaced. Each button 130, in turn, becomes a "lock button" or a "stop button" depending on the orientation of the respective tab 120 to which it is attached. Still referring to FIG. 3, the button 130', being translationally coupled to the lock tab 120', is an example of a lock button. The button 130", being translationally coupled to the stop tab 120", is an example of a stop button. Different numbers imprinted on the buttons 130 allow the user to remember which buttons 130 are which. A user may, for example, in one non-limiting illustrative embodiment, have buttons 130 that are labeled 2, 4, and 7 configured as lock buttons, with the remainder of the buttons 130 (i.e., those labeled 1, 3, 5, 6, and 8-10) configured as stop buttons. These particular assignments are, however, only by way of example, and a user may configure the buttons in any manner that particular user wishes. In other embodiments, rather than the buttons 130 being labeled by different numerals in the manner shown in FIG. 1, the various buttons can be differentiated from each other by different textures, symbols or colors. A user would then remember which buttons are configured as lock buttons and stop buttons by those textures, symbols, or colors rather than by the numerals.

The container assembly 110 comprises a container 165 and a locking tray 170, which is affixed to the top of the container 165 by, for example, an adhesive. The container defines a necked opening 172 that is surrounded by the locking tray 170. The locking tray 170 is circular and defines an externally threaded hollow cylinder 175 at its center with a plurality of outward-facing notches 180 about its base. An outer circumferential ring 185 that encircles the externally threaded hollow cylinder 175 defines a plurality of inward-facing teeth 190 about its circumference. Each of the inward-facing teeth 190 is configured with a respective portion having a moderate inward slope, a respective portion that is relatively flat, and a respective portion with a steeper outward slope (i.e., about 90 degrees relative to the outside edge of the outer circumferential ring 185).

Figure 5:
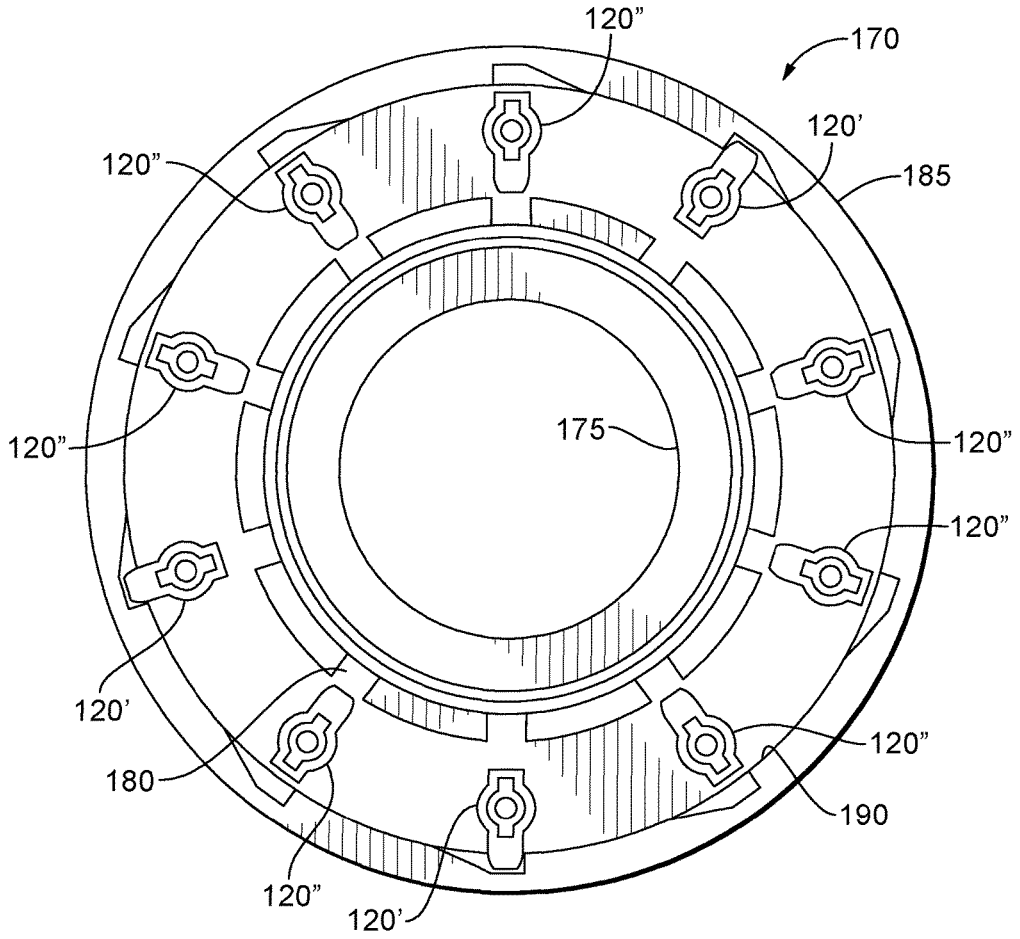
FIGS. 5-7 show plan views of the cooperation between the tabs and the locking cap in the FIG. 1 apparatus to create various locked/unlocked states for the apparatus.
Figure 6:
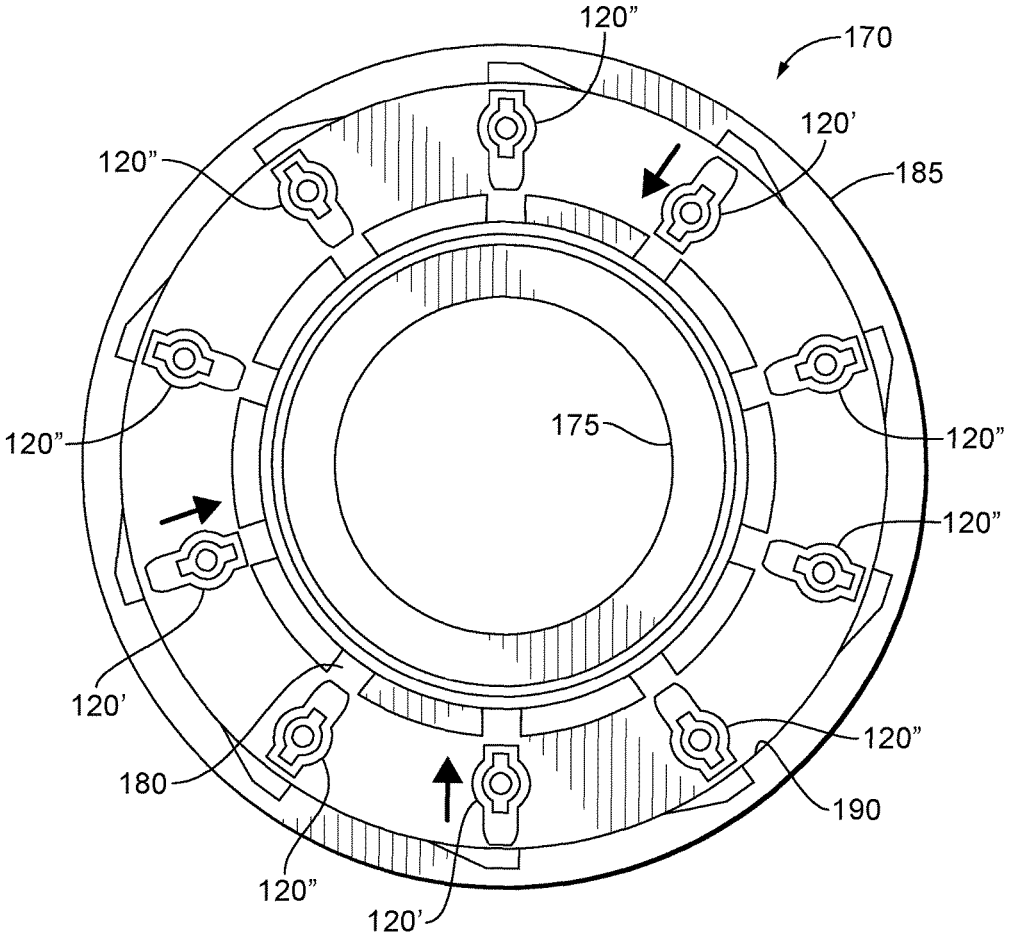
Figure 7:
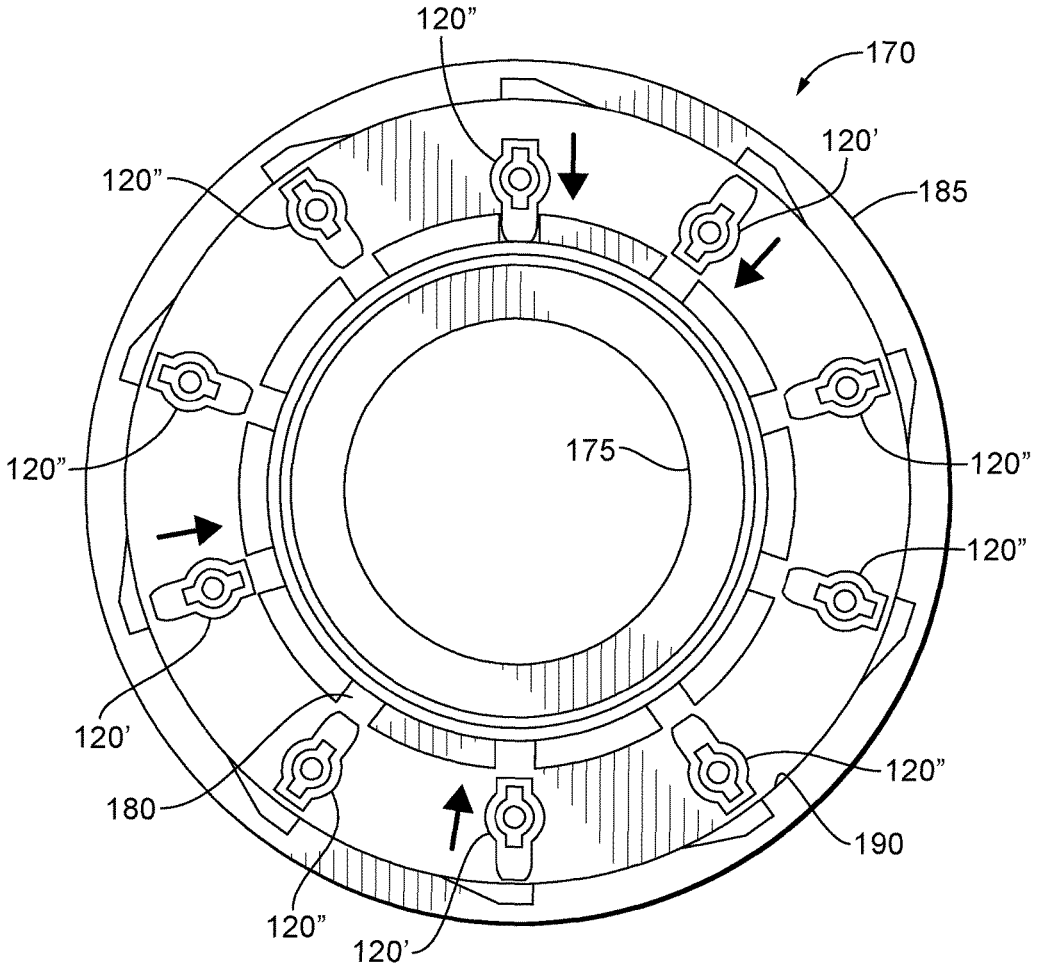

In use, the tabs 120 of the cap assembly 105 interact with the locking tray 170 of the container assembly 110 when the cap assembly 105 is threadably coupled with the container assembly 110. This interaction provides the desired locking/unlocking functionality between the cap assembly 105 and the container assembly 110. Details of the interaction are illustrated in FIGS. 5-7, which provide plan views of the cooperation between the tabs 120 and the locking tray 170 with the apparatus 100 in various configurations. In these figures, the illustrative cap assembly 105 is configured with three lock tabs 120' and seven stop tabs 120".

To affix the cap assembly 105 to the container assembly 110, the internally threaded hollow cylinder 145 of the cap assembly 105 is threadably engaged with the externally threaded hollow cylinder 175 of the container assembly 110. When nearing full engagement, the lock tabs 120' engage with the inward-facing teeth 190 of the outer circumferential ring 185 with the lock tabs 120' acting like pawls in the manner of a ratchet mechanism. Once engaged in this manner, the engagement of the lock tabs 120' with the outer circumferential ring 185 prevents the cap assembly 105 from being unscrewed from the container assembly 110 without pressing any buttons 130. This configuration is illustrated in FIG. 5.

Now in a locked state with the cap assembly 105 fully threadably engaged with the container assembly 110, the cap assembly 105 may be unscrewed from the container assembly 110 only by simultaneously pressing the lock buttons 130' without pressing any of the stop buttons 130". With the lock buttons 130' simultaneously and exclusively pressed, the lock tabs 120' are slid inward to their inward positions and will disengage from the outer circumferential ring 185 of the locking tray 170, and, so placed, neither the lock tabs 120' nor the stop tabs 120" will interfere with the rotation of the cap assembly 105. This is the configuration shown in FIG. 6. The cap assembly 105 may then be readily unscrewed from the container assembly 110. However, if any one of the stop buttons 130" is pressed (either alone or in combination with any of the lock buttons 130'), the stop tab 120" associated with that stop button 130" will be moved to its inward position and will engage one of the outward-facing notches 180 at the base of the externally threaded hollow cylinder 175 of the locking tray 170. That engagement will inhibit the unscrewing of the cap assembly 105. This is precisely the condition shown in FIG. 7, wherein the stop button 130" associated with the stop tab 120" in the twelve o'clock position has been pressed.

A user of the apparatus 100 must therefore simultaneously and exclusively press the lock buttons 130' while not pressing any of the stop buttons 130" to be able to open the apparatus 100 and access the beverage inside. This means that only someone knowing which of the buttons 130 to press (i.e., the lock buttons 130') can access the beverage inside the container assembly 110. Someone without that knowledge (i.e., a potential perpetrator) will find opening the apparatus 100 very difficult, particularly if that person has little time to experiment. An attempt to push all the buttons 130 at once in a gross attempt to open the apparatus 100, for example, will not allow the cap assembly 105 to be removed from the container assembly 110. Advantageously, as indicated above, the assignments of what buttons are stop buttons and what buttons are lock buttons for a given apparatus 100 can be readily customized by the user, meaning that one apparatus will almost certainly have a different "combination" than another that might be present at the same social gathering.

Also, advantageously, once understood from the teachings herein, the apparatus 100 may be manufactured by one having ordinary skill in the relevant manufacturing arts utilizing conventional manufacturing processes. The components of the apparatus 100 minus the springs 135 and the screws 140, for example, may be formed of plastic and may be formed by conventional plastic forming processes such as, but not limited to, injection molding. The springs 135 and the screws 140 may be sourced commercially.

In closing, it should again be emphasized that the above-described embodiments of the invention are intended to be illustrative only. Other embodiments can use different types and arrangements of elements for implementing the described functionality. These numerous alternative embodiments within the scope of the appended claims will be apparent to one skilled in the art.

Moreover, all the features disclosed herein may be replaced by alternative features serving the same, equivalent, or similar purposes, unless expressly stated otherwise. Thus, unless expressly stated otherwise, each feature disclosed is one example only of a generic series of equivalent or similar features.

What is claimed is:

1. An apparatus comprising:

a container;

a locking tray attached to the container and comprising:

an externally threaded cylinder defining a plurality of outward-facing notches about its base; and an outer circumferential ring defining a plurality of inward-facing teeth about its circumference;

a cap assembly comprising:

an internally threaded cylinder;

a lock tab operative to slide radially towards and away from the internally threaded cylinder between an inward position and an outward position;

a spring-biased lock button translationally coupled to the lock tab and urging the lock tab towards its outward position when the spring-biased lock button is unpressed and positioning the lock tab in its inward position when the spring-biased lock button is pressed;

a stop tab operative to slide radially towards and away from the internally threaded cylinder between an inward position and an outward position; and a spring-biased stop button translationally coupled to the stop tab and urging the stop tab towards its outward position when the spring-biased stop button is unpressed and positioning the stop tab in its inward position when the spring-biased stop button is pressed; wherein:

the lock tab is operative to engage one or more of the plurality of inward-facing teeth as the internally threaded cylinder is threadably engaged with the externally threaded cylinder with the spring-biased lock button unpressed; and the stop tab is operative to engage one of the plurality of outward-facing notches with the internally threaded cylinder threadably engaged with the externally threaded cylinder and the spring-biased stop button pressed.

2. The apparatus of claim 1, wherein the container defines a necked opening that is encircled by the locking tray.

3. The apparatus of claim 1, wherein the locking tray is circular.

4. The apparatus of claim 1, wherein the outer circumferential ring encircles the externally threaded cylinder.

5. The apparatus of claim 1, wherein each of the plurality of inward-facing teeth is asymmetrical with a respective inward slope, a respective flat portion, and a respective outward slope.

6. The apparatus of claim 1, wherein:

the lock tab defines a keyhole; and the spring-biased lock button defines a projection with a keyed shape positioned in the keyhole.

7. The apparatus of claim 6, wherein the cap assembly defines a button slot and the projection passes through the button slot.

8. The apparatus of claim 1, wherein the cap assembly further comprises a screw that fixates the lock tab to the spring-biased lock button.

9. The apparatus of claim 1, wherein the lock tab and the stop tab are substantially identical in shape.

10. The apparatus of claim 1, wherein the spring-biased lock button and the spring-biased stop button are labeled with different numerals or different symbols from each other.

11. The apparatus of claim 1, wherein the spring-biased lock button and the spring-biased stop button are different colors from each other.

12. The apparatus of claim 1, wherein, with the internally threaded cylinder fully threadably engaged with the externally threaded cylinder, the cap assembly may not be manually unscrewed from the locking tray with the spring-biased lock button unpressed.

13. The apparatus of claim 1, wherein, with the internally threaded cylinder fully threadably engaged with the externally threaded cylinder, the cap assembly may not be manually unscrewed from the locking tray with the spring-biased stop button pressed.

14. The apparatus of claim 1, wherein, with the internally threaded cylinder fully threadably engaged with the externally threaded cylinder, the lock tab does not engage any of the plurality of the inward-facing teeth or any of the plurality of the outward-facing notches with the spring-biased lock button pressed.

15. The apparatus of claim 1, wherein the lock tab defines a longer projection and a shorter projection, the shorter projection being opposite the longer projection.

* * * * *